US012421735B2

(12) United States Patent
Marquez Yuste

(10) Patent No.: US 12,421,735 B2
(45) Date of Patent: Sep. 23, 2025

(54) SYSTEM FOR LEVELLING CERAMICS

(71) Applicant: Protosafe, S.L., Jijona (ES)

(72) Inventor: Juan Carlos Marquez Yuste, Jijona (ES)

(73) Assignee: Protosafe, S.I., Jijona (ES)

( * ) Notice: Subject to any disclaimer, the term of this patent is extended or adjusted under 35 U.S.C. 154(b) by 373 days.

(21) Appl. No.: 18/030,345

(22) PCT Filed: Oct. 5, 2021

(86) PCT No.: PCT/ES2021/070723
§ 371 (c)(1),
(2) Date: Apr. 5, 2023

(87) PCT Pub. No.: WO2022/074275
PCT Pub. Date: Apr. 14, 2022

(65) Prior Publication Data

US 2023/0366211 A1 Nov. 16, 2023

(30) Foreign Application Priority Data

Oct. 5, 2020 (ES) ..... ES202031007

(51) Int. Cl.
*E04F 21/22* (2006.01)
*E04F 15/02* (2006.01)
*E04F 21/18* (2006.01)

(52) U.S. Cl.
CPC .... *E04F 15/02022* (2013.01); *E04F 21/1877* (2013.01); *E04F 21/22* (2013.01)

(58) Field of Classification Search
CPC .. E04F 15/02022; E04F 21/1877; E04F 21/22
(Continued)

(56) References Cited

U.S. PATENT DOCUMENTS 5,359,783 A * 11/1994 Smith ..... E04F 21/0092 33/526
6,612,045 B2 * 9/2003 Kruskamp ..... E04F 21/0092 33/645

(Continued)

FOREIGN PATENT DOCUMENTS

| | | | |
|---|---|---|---|
| CN | 204139562 | U | 2/2015 |
| EP | 3604707 | A1 | 2/2020 |
| WO | 2018172802 | A1 | 9/2018 |

OTHER PUBLICATIONS

International Search Report for Application No. PCT/ES2021/070723 dated Dec. 1, 2021 with English Translation.

*Primary Examiner* — George B Bennett
(74) *Attorney, Agent, or Firm* — Farber LLC

(57) ABSTRACT

This invention refers to a one-piece ceramic-tile levelling system comprised of a base from which a longitudinally partially-threaded stem rises perpendicular to the flat surface of the base. The device also consists of a torque hood composed of a partially-threaded cylindrical orifice, to the walls of which said stem is attached in an arrangement concentric to said orifice by means of frangible connections. The stem thread and the torque hood thread are complementary to one another so that when the frangible connections are broken, the torque hood is screwed onto the stem in such a way that a face of the torque hood parallel to the flat surface of the base closes in on the same, levelling the two adjacent tiles as it does so.

5 Claims, 3 Drawing Sheets

(58) Field of Classification Search
USPC ..... 33/526, 527
See application file for complete search history.

(56) References Cited

U.S. PATENT DOCUMENTS

| | | | | |
|---|---|---|---|---|
| 7,946,093 | B1 * | 5/2011 | Sturino | E04F 21/0092 52/749.11 |
| 8,635,815 | B2 * | 1/2014 | Bordin | E04F 21/0092 52/749.11 |
| 9,470,002 | B2 * | 10/2016 | Irvine | E04F 21/1877 |
| 9,482,019 | B2 * | 11/2016 | Fontana | E04F 21/22 |
| 9,657,485 | B2 * | 5/2017 | Meyers | E04F 21/22 |
| 10,577,813 | B2 * | 3/2020 | Dahill | E04F 21/22 |
| 11,028,601 | B2 * | 6/2021 | Nudo | E04F 21/1877 |
| 11,428,019 | B2 * | 8/2022 | Sighinolfi | E04F 21/0092 |
| 11,624,194 | B2 * | 4/2023 | Bunch | B67B 7/16 33/533 |
| 12,065,843 | B2 * | 8/2024 | Caruso | E04F 21/0092 |
| 2013/0255182 | A1 | 10/2013 | Kufner et al. | |
| 2019/0242143 | A1 | 8/2019 | Dahill | |
| 2020/0149296 | A1 | 5/2020 | Bedrosian et al. | |
| 2025/0137269 | A1 * | 5/2025 | Delle Vedove | E04F 21/1877 |

* cited by examiner

SYSTEM FOR LEVELLING CERAMICS

FIELD OF THE INVENTION

The invention belongs to the technical field of auxiliary tools and utilities for construction. In particular, it refers to a tile-levelling system, composed of a single apparatus, for paving floors and walls with ceramic tiles that achieves faster installation of the tiling at a lower cost than devices known in the prior art.

BACKGROUND OF THE INVENTION

There are currently several tile-levelling systems for paving floors, among which wedge systems and stem systems are the most common.

In wedge systems, a first piece or base is placed under the edge of the ceramic tiles and then a second wedge-shaped piece is inserted into the part of the base that projects above the topside of the tile. A uniform compressing force, which levels the adjacent tiles, is then exerted between the base and the wedge. In these systems it is necessary to use a special tool to exert pressure on the wedge between the levelling device and the tiles.

Stem systems also consist of two pieces; the first is a base that includes a threaded stem that rises perpendicular to the base and the second is a tightener that can be screwed onto the base stem or attached to it by means of a toothed ratchet system. Tightening can be done manually but a tightening tool is sometimes required or recommended as well.

In both cases, after laying the tiles the levelling systems are removed by breaking off the protruding part, leaving the bases concealed under the tiles. The protruding parts have to be recycled because they are not reusable and the wedges or tightening components must be separated from the base pieces and collected for reuse.

These tile-levelling systems have the following drawbacks.

In the first place, since they consist of two pieces that must be assembled one on top of the other when laying the ceramic tiles, they make the laying process more complicated than necessary with the consequent cost in time and money.

Secondly, once all the tiles have been laid, the wedges or tightening components must be recovered for reuse, thus making installation of the tiles more expensive due to the time it takes to detach and collect them.

Thirdly, the fact that the system is composed of at least two pieces also makes the production cost of the levelling system more expensive since two different moulds are required to manufacture them in two different production runs of plastic injection machines. This expense can constitute a key factor for the profitability of tile installation for masons.

Finally, it should be mentioned that a special tool—such as dedicated pliers to exert pressure on the wedge or a utility to screw the tightening component onto the base stem—is sometimes required to tighten or compress and effectively level the tiles. This fact makes levelled installation of ceramic floors tedious and slow, and the cost is also increased by the currently-available levelling systems.

Document US2013/0255182 A1 describes a levelling system for ceramic tiles consisting of a single apparatus comprised of a base, a stem and two articulated "flexible members" or arms that project from the stem in opposite directions and which compress the ceramic tiles by pivoting downwards and pressing against each other in a pincer-like movement until a "protruding fastening member" on the arms is retained in a recess in the stem. The main disadvantage of this system is that the thickness of the tiles to which it is applicable is limited to a very narrow range determined by the length of the arms and the stem. In addition, the break-off points are located directly on the base and therefore the base is not provided with a spacer to regulate the distance between tiles, which could be of variable width.

SUMMARY OF THE INVENTION

An initial description of the invention presents a one-piece ceramic-tile levelling system comprised of a base that includes a longitudinally partially-threaded stem that rises perpendicular to the flat surface of the base. This stem consists of a torque hood composed of a partially-threaded cylindrical orifice, to the walls of which said stem is attached in an arrangement concentric to said orifice by means of frangible connections. The stem thread and the torque-hood thread are complementary to one another so that when the frangible connections are broken, the torque hood is screwed onto the stem in such a way that a face of the torque hood parallel to the flat surface of the base approaches the same, levelling the two adjacent tiles as it does so. In practice, the base is attached to the stem by means of one or more weak points such that after the tiles have been levelled, it is easy to separate the base from the rest of the apparatus by breaking the stem at one or more of said weak points.

With a tile-levelling system such as the one described above, a mason can pave a floor with levelled ceramic tiles more quickly than with any other known tile-levelling system due to the fact that it consists of one apparatus only and can be installed with a one hand: that which puts it in place and then breaks the frangible connections and tightens the hood. Furthermore, if it is wrongly placed the first time, the operator only needs to unscrew the hood to remove the entire one-piece device.

The one-piece ceramic-tile levelling system is preferably configured to be manufactured by injection moulding in a single production run. Thus, since it is manufactured by a one sole injection into a single mould, the initial manufacturing costs will be reduced compared to the prior art due to the fact that two moulds—one for the stem and another for the hood—are not required. With suitable configuration, the one-piece levelling device can be manufactured with one injection into only one mould. Consequently, there are no assembly or post-processing costs associated with the device since it is already fully assembled and ready to use when it exits the injection machine.

Optionally, the relative angular orientation of the torque hood and the stem is such that by manually pressing on the torque hood and breaking the frangible connections, the torque hood slides down the stem until the beginning of the stem thread is positioned adjacent to the entry point of the torque hood's thread. Thus, screwing the torque hood onto the stem begins immediately on rotating it in the tightening direction. The thread is engaged immediately without wasting time and it is only necessary to turn the torque hood between half a turn and two turns to level the tiles.

The base is preferably attached to the stem by means of one or more weak points. Thus, after the levelling the tiles, the base 12 is easy to separate from the rest of the device by breaking it at one or more of the weak points by hitting the exposed part of the device with a mallet, for example.

The stem consists of a flat region, thinner than the rest of the stem, located between the base and the stem thread and configured to abut the tiles during the levelling process. This flat area makes orientation of the device with respect to the adjacent tiles easier. It also acts as a separator or spacer, ensuring that the gap between adjacent tiles is always the same due to the fact that the tile's edges abut the stem's flat region.

This flat area has different widths or thicknesses in different embodiments of the invention, which means that the levelling system can be used to produce gaps of different sizes between the tiles. This can be achieved by using a single injection mould and employing inserts of different flat widths to form the base, thus changing the thickness of the flat area adjacent to the base.

The torque hood preferably consists of a conical cowling on which a series of regularly-spaced fins extends radially from its centre. This arrangement enhances the operator's grip on the hood, thus making it easier to apply torque by hand to screw it down.

BRIEF DESCRIPTION OF THE DRAWINGS

An embodiment of this invention, purely by way of example, is described in detail below. Said embodiment should not be construed as constituting a limitation of the scope of protection of this application, which shall be defined by the claims set forth below. Reference is made in the detailed description to the figures attached hereto, in which:

DETAILED DESCRIPTION OF THE INVENTION

Figure 1A:
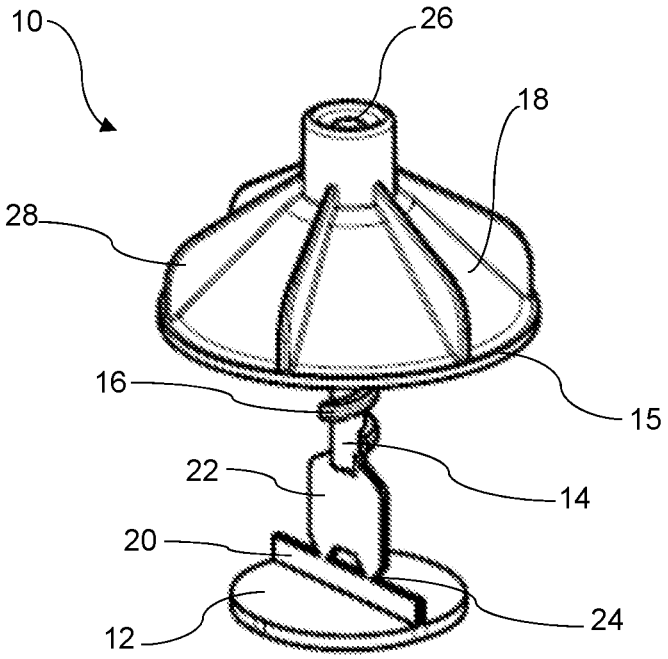
FIGS. 1A and 1B represent perspective views of an embodiment of this invention from two different angles.

FIG. 1A shows a perspective view of one embodiment of this invention.

Figure 1B:
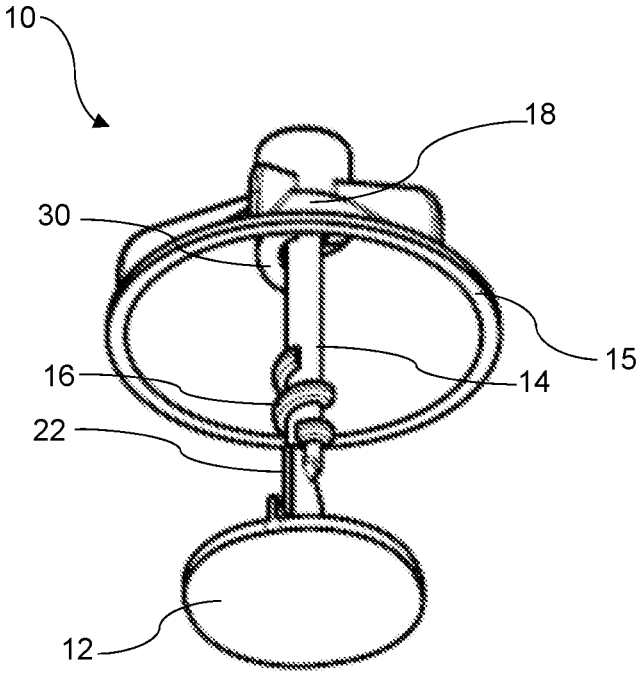

FIG. 1 shows a levelling system 10 for ceramic tiles or similar construction materials made up of a single apparatus 10 that includes a base 12. A stem 14, partially longitudinally threaded, extends perpendicularly from the base 12. The device 10 consists of a torque hood or cowling 18 provided with a partially-threaded cylindrical orifice 26. The stem 14 is joined to the walls of the orifice 26 in a concentric arrangement to said orifice 26 by means of three frangible connections (concealed) arranged regularly around the stem 14 and on the thread 30 of the cylindrical orifice 26.

The thread of the stem 16 and the thread of the torque hood 30 are complementary to each other, so that by breaking the frangible connections in use, the torque hood 18 can be screwed onto the stem 14 in such a way that the underside 15 of said torque hood 14, being parallel to the flat surface of the base 12, closes in on the latter causing the compression that levels the adjacent tiles.

The base 12 is also attached to the stem 14 by means of two weak points 24 in such a way that once the tiles have been levelled, the base 12 is easily separated from the protruding part by breaking the weak points 24 by, for example, striking the remaining part of the device with a mallet.

The torque hood 18 is comprised of a conical cowling provided with a series of evenly-distributed fins 28 extending radially from the centre of the hood 18 perpendicular to the conical cowling of the same. The purpose of these fins is to make it easier to apply torque to the hood 18 to rotate it on the stem 14 by improving the operator's grip on said hood 18.

The stem 14 consists of a flat region 20 of reduced thickness with respect to the rest of the stem—1 mm in this case—adjacent to the base 12 so that the device 10 can be placed adjacent to a tile with the flat region 20 parallel to the edge of same. Thus the next tile is placed adjacent to the first with a minimum gap between them, in such a way that the levelling system is located between the two tiles.

Figure 2A:
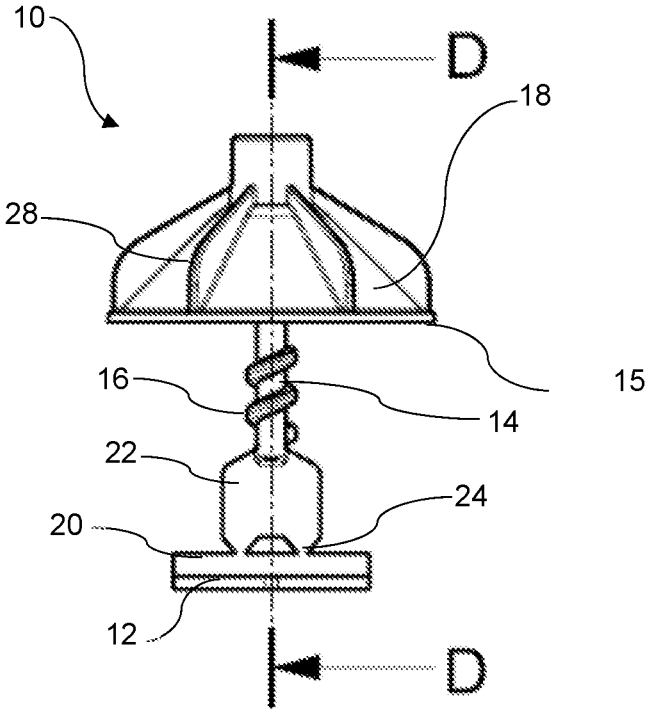
FIG. 2A represents a front view of the embodiment shown in FIGS. 1A and 1B.
Figure 2B:
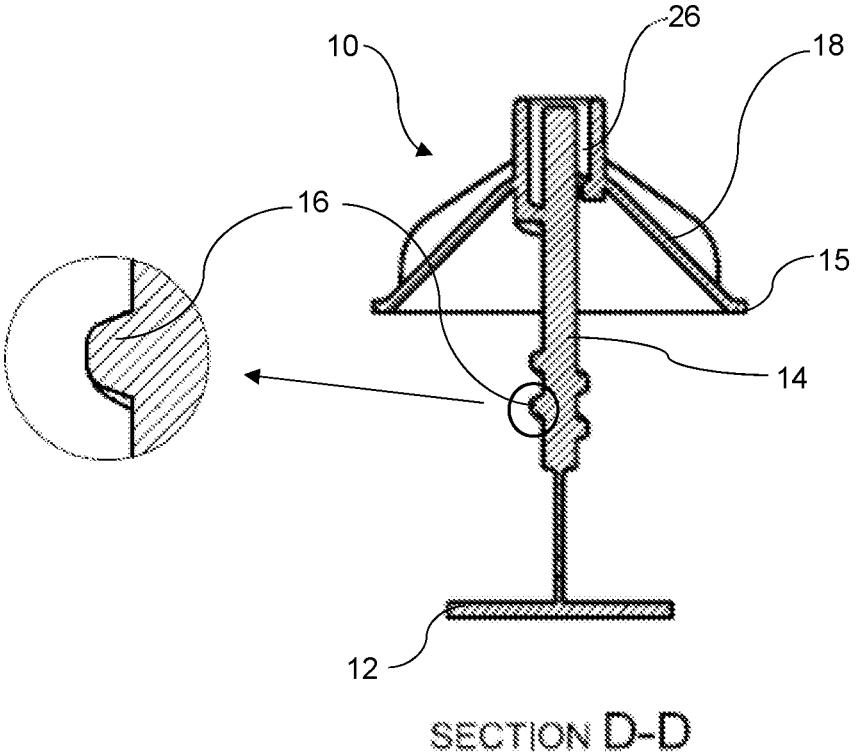
FIG. 2B represents a view of the cross-section D-D indicated in FIG. 2A and a detail showing the stem thread.

The thread of the stem 16, shown in detail in FIGS. 2A and 2B, is located adjacent to a second flat region 22 of the same. Said thread has a 6-mm pitch and extends through two full turns of thread, that is, over 12 mm of the stem 14. The thread profile is trapezoidal with rounded outer edges. The root of the thread is 3 mm wide, the width at its crest is 1.09 mm and the inclination of its flanks on the wall of the stem is 21 with the result that the thread is 2.1 mm high.

The relative orientation of the torque hood 18 and stem 14 is such that by manually pressing on the torque hood 14 and breaking the frangible connections, the torque hood 18 slides on the stem 14 until the beginning of the thread of stem 16 is located at the entrance to the thread 30 of the torque hood 18. At this point only two turns of the of torque hood 18 and its thread are required to compress and level the adjacent tiles.

The total height of the one-piece levelling system 10 is 69.5 mm. The torque hood 18 is 50 mm in diameter and 28.5 mm high. The base 12 is 30 mm in diameter and the stem diameter is 4.5 mm.

The one-piece levelling system 10 is produced by propylene injection moulding in a single injection, after which it is packaged directly on exit from the injection machine. This means that the investment required to make a single mould and the production cost of the device is very low since it does not require assembly or any other post-injection operation. To sum up, this levelling system entails a reduced initial investment (in a single mould), low manufacturing cost (absence of post-injection assembly tasks) and a faster implementation method (the base and the torque hood are preassembled and joined by frangible connections). Removal of the remaining parts after levelling is faster since, due to their low cost, reuse of the same is economically inviable.

FIGS. 3A, 3B, 3C and 3D show a tile-levelling method 40, 42 using a levelling system as depicted in FIG. 1.

Figure 3A:
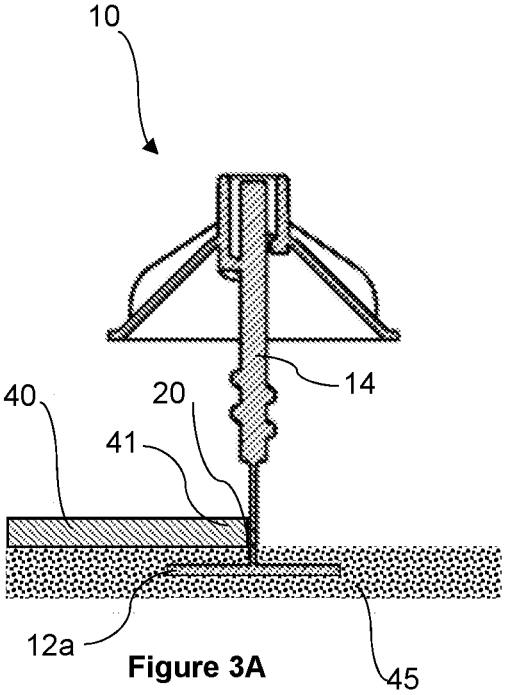
FIGS. 3A, 3B, 3C and 3D illustrate the tile-levelling method using the levelling system shown in FIGS. 1A and 1B.

FIG. 3A shows how the one-piece tile-levelling system 10 is positioned so that the flat region 20 of the stem 14 abuts an edge 41 of the tile 40 and half the base 12*a* is positioned under a tile 40.

Figure 3B:
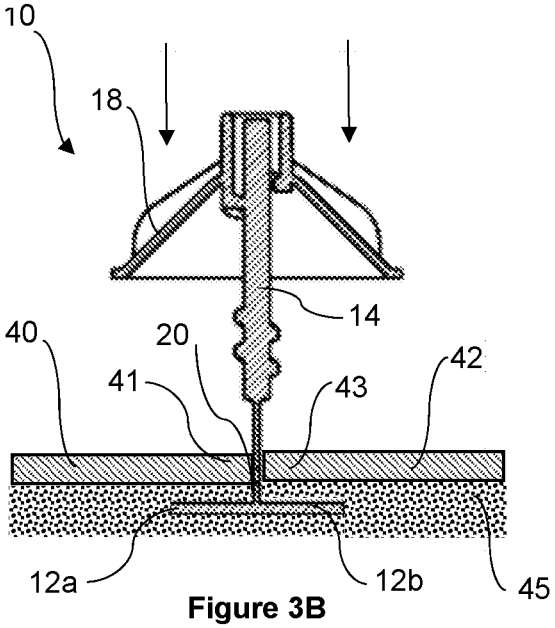
Figure 3C:
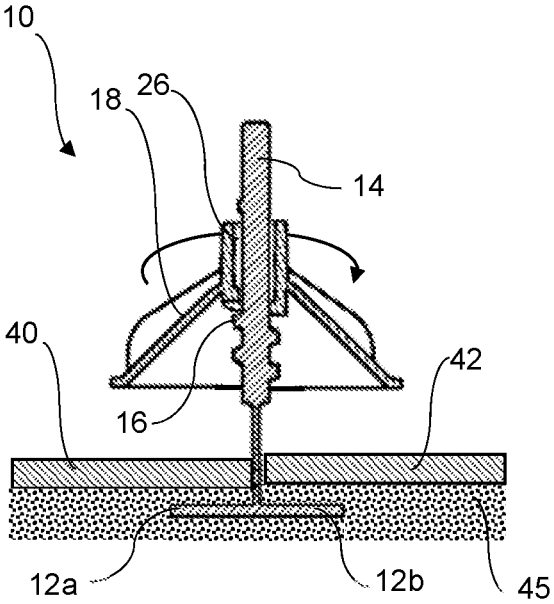
Figure 3D:
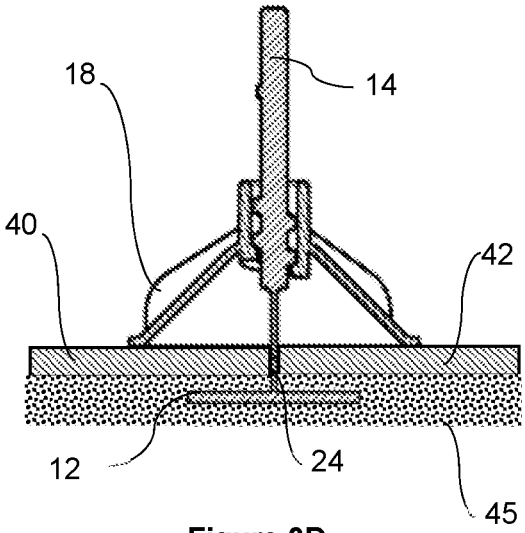

Then, FIG. 3B shows how the next tile 42 is placed so that one of its edges 43 abuts the opposite face of the flat region 22 of the stem 14 and covers the other half 12*b* of the base of the device 10.

The following FIG. 3B shows how a vertical force (indicated by arrows) is manually applied to the torque hood 18 until the frangible connections attaching it to the stem 14 break. This gives rise to the situation depicted in FIG. 3C, where the torque hood 18 rests on the stem thread 16 in a position in which the beginning of the stem thread 16 coincides with the start of the thread of the cylindrical orifice 26 of the torque hood 18. Now, without removing the hand from the torque hood 18, the operator rotates it until the two tiles 40, 42 are clamped and levelled between the lower edge of the hood 18 and the upper surface of the base 12, at which point the levelling process is complete.

Once the cement 45 dries, the device 2 breaks off at the weak points 24 as a result of a blow to the stem, leaving only the base 12 concealed under the tiles. The rest of the device is thrown into the recycling bin.

The invention claimed is:

1. A one-piece tile-levelling system which comprises a base from which a longitudinally partially-threaded stem extends perpendicularly, a torque hood defining a partially-threaded orifice, and the stem is joined to the walls of said torque hood in a concentric arrangement with said orifice by means of frangible connections, the thread of the stem and the thread of the torque hood are complementary to each other, so that by breaking the frangible connections in use, the torque hood can be screwed onto the stem in such a way that the underside of said torque hood, being parallel to the flat surface of the base, closes in on the latter and levels the adjacent tiles.

2. A tile-levelling system according to claim 1, wherein the system is configured to be produced by injection moulding in a single operation.

3. A tile-levelling system according to claim 1 wherein the base is attached to the stem by means of one or more weak points.

4. A tile-levelling system according to claim 1 wherein the stem comprises a flat region, thinner than the rest of the stem, located between the base and the stem thread and configured to abut the tiles during the levelling process.

5. A tile-levelling system according to claim 1 wherein the torque hood comprises a conical cowling on which a series of regularly-spaced fins extends radially from its centre.

* * * * *